United States Patent [19]

Taplin

[11] 4,010,717

[45] Mar. 8, 1977

[54] FUEL CONTROL SYSTEM HAVING AN AUXILIARY CIRCUIT FOR CORRECTING THE SIGNALS GENERATED BY THE PRESSURE SENSOR DURING TRANSIENT OPERATING CONDITIONS

[75] Inventor: Lael Brent Taplin, Royal Oak, Mich.

[73] Assignee: The Bendix Corporation, Southfield, Mich.

[22] Filed: Feb. 3, 1975

[21] Appl. No.: 546,239

[52] U.S. Cl. ..... 123/32 EH; 23/32 ED

[51] Int. Cl.² ..... F02B 3/00

[58] Field of Search ..... 123/32 EA, 32 CH, 32 ED, 123/117 R

[56] References Cited

UNITED STATES PATENTS

| | | | |
|---|---|---|---|
| 2,845,910 | 8/1958 | Pribble | 123/32 EA |
| 2,941,519 | 6/1960 | Zechnall | 123/32 EA |
| 3,051,152 | 8/1962 | Paule | 123/32 EA |
| 3,272,187 | 9/1966 | Westbrook | 123/32 EA |
| 3,456,628 | 7/1969 | Bassot | 123/32 EA |
| 3,548,791 | 12/1970 | Long | 123/32 EA |
| 3,566,847 | 3/1971 | Scholl et al. | 123/32 EA |
| 3,661,126 | 5/1972 | Baxendale | 123/32 EA |
| 3,673,989 | 7/1972 | Aono et al. | 123/32 EA |
| 3,719,176 | 3/1973 | Shinoda et al. | 123/32 EA |
| 3,720,191 | 3/1973 | Rachel | 123/32 EA |
| 3,734,068 | 5/1973 | Reddy | 123/119 R |
| 3,749,065 | 7/1973 | Rothfusz et al. | 123/32 EA |
| 3,789,816 | 2/1974 | Taplin et al. | 123/32 EA |
| 3,794,003 | 2/1974 | Reddy | 123/32 EA |
| 3,835,820 | 9/1974 | Fujisawa et al. | 123/32 EA |
| 3,842,811 | 10/1974 | Shinoda et al. | 123/32 EA |
| 3,858,561 | 1/1975 | Aono | 123/32 EA |

*Primary Examiner*—Ronald B. Cox
*Attorney, Agent, or Firm*—James R. Ignatowski; Russel C. Wells

[57] ABSTRACT

A fuel control system having an auxiliary circuit for correcting the signals generated by a pressure sensor under transient operating conditions is disclosed. The circuit generates a pressure correction signal directly proportional to the first time derivative of the intake manifold pressure and inversely proportional to rotational speed of the engine which is added to the signal generated by the pressure sensor. The added signals are utilized by the electronic control unit for computing the fuel requirements of the engine to maintain a constant fuel/air ratio during steady state and transient operating conditions.

23 Claims, 5 Drawing Figures

FUEL CONTROL SYSTEM HAVING AN AUXILIARY CIRCUIT FOR CORRECTING THE SIGNALS GENERATED BY THE PRESSURE SENSOR DURING TRANSIENT OPERATING CONDITIONS

BACKGROUND OF THE INVENTION

1. Field of the Invention

The invention is related to the field of electronic fuel control for internal combustion engines and, in particular, the invention is related to the electronic computation of engine fuel requirements during transient modes of operation as determined from the engine speed and pressure in the intake manifold.

2. Prior Art

Fuel delivery to internal combustion engines during transient modes of operation such as acceleration or deceleration has been extensively treated in the prior art. Electronic control units for electronic fuel injection (EFI) equipped engines normally have auxiliary circuits of various types for enriching the fuel mixture during acceleration and decreasing or terminating the fuel delivery during deceleration. Acceleration fuel enrichment circuit, such as disclosed by R. W. Rothfuse and J. R. Nagy U.S. Pat. No. 3,749,065), generates a first fuel enrichment signal operative to inject a predetermined quantity of fuel into the engine immediately upon the receipt of an acceleration command independent of the injection signals generated by the electronic control unit. In addition to the first enrichment signal, the enrichment circuit also increased the duration of the injection pulses generated by the electronic control unit. Injection pulses with increased duration are generated as long as a signal indicative of the acceleration command exists. Rachel, in U.S. Pat. No. 3,720,191, teaches a similar system in which the increased length of the injection pulses generated by the electronic control unit is dependent upon the magnitude and duration of the demanded acceleration derived from a potentiometer mechanically linked to the throttle mechanism. The added increment to the injection pulses exponentially decays after the demand for acceleration is terminated. Long, in U.S. Pat. No. 3,548,791, teaches an acceleration enrichment circuit in which the signal indicative of a demand for acceleration is a pressure change in the intake manifold. In the Long system the demand for acceleration changes a mode of operation of the electronic control unit which, in response to an acceleration demand, produces additional enrichment fuel injection pulses at a rate equal to a firing rate of the cylinders. The duration of these additional acceleration pulses is fixed and the number of pulses is dependent upon the magnitude of the acceleration signal. Ono et al, in U.S. Pat. No. 3,673,989, teaches two acceleration enrichment circuits. The first circuit is triggered by a differentiator circuit responding to the change in pressure in the intake manifold and generates, at a predetermined frequency, a series of injection pulses having fixed pulse widths. The second circuit integrates the acceleration signal and provides a bias signal to the electronic control unit which extends the length of the injection pulses for a fixed period of time. Kazuo Shinoda et al, in U.S. Pat. No. 3,719,176, teaches an acceleration enrichment circuit in which an acceleration signal derived from the intake manifold pressure is integrated to modify the duration of the injection pulses generated by the electronic control unit. The integrated pressure signal is applied to a pulse width modification circuit which generates primary pulses which decay during the decay time of the integration circuit.

The above described patents are indicative of the state of the art of the techniques used for fuel enrichment during acceleration periods. The reading of prior art reveals that acceleration fuel enrichment and deceleration fuel curtailment has been treated empirically by those skilled in the art. The present invention relates to an electronic fuel control system in which the engine's fuel requirements are computed in accordance with the actual air flow to the engine derived from both static and dynamic measurements of the pressure in the engine's air intake manifold. By utilizing both the dynamic and static components of the pressure in the intake manifold, the fuel enrichment for acceleration or fuel leaning for deceleration are computed on the basis of actual air flow. The dynamic component of the pressure signal provides a first order correction to the computed fuel requirements during the transient modes of operation. Empirical corrections such as made in the prior art are then relegated to a secondary type of correction which corrects for such things as wall wetting, engine and air temperatures and other factors not associated with the air flow to the engine.

SUMMARY OF THE INVENTION

The invention is a fuel control system for an internal combustion engine having an electrical circuit correcting the signals generated by a pressure sensor for the compressibility of the air during transient conditions. This circuit provides a more accurate pressure signal for the subsequent computation of fluid flow base on the physical parameters of the system and the measured pressure. The corrected pressure signals, along with signals indicative of the rotational speed of the engine, are indicative of the air flow and are utilized by the electronic fuel control system for computing the engine's fuel requirements.

The disclosed circuit computes a pressure correction signal having a value proportional to the first derivative of the pressure in the intake manifold and inversely proportional to the rotational speed of the engine which is added to the generated pressure signal to correct for the compressibility of the air in the engine's intake manifold during transient operation. The circuit comprises a differentitor generating a derivative signal proportional to the first derivative of the pressure signal, a circuit dividing the derivative signal by a speed signal to generate a correction signal and circuit means for combining the correction signal to generate a corrected pressure signal.

The object of this invention is to provide for a utilization device control system, an auxiliary circuit generating a corrected pressure signal to compensate for the compressibility of the fluid during transient states of operation. In particular, the objective of this invention is an electronic control unit of a fuel injection equipped internal combustion engine having an auxiliary circuit for generating a corrected pressure signal having a component proportional to the first derivative of the pressure in the engine's intake manifold and inversely proportional to the speed of the engine. The advantages of this inventive system will become apparent from the reading of the specification and claims.

DETAILED DESCRIPTION OF THE PREFERRED EMBODIMENT

Figure 1:
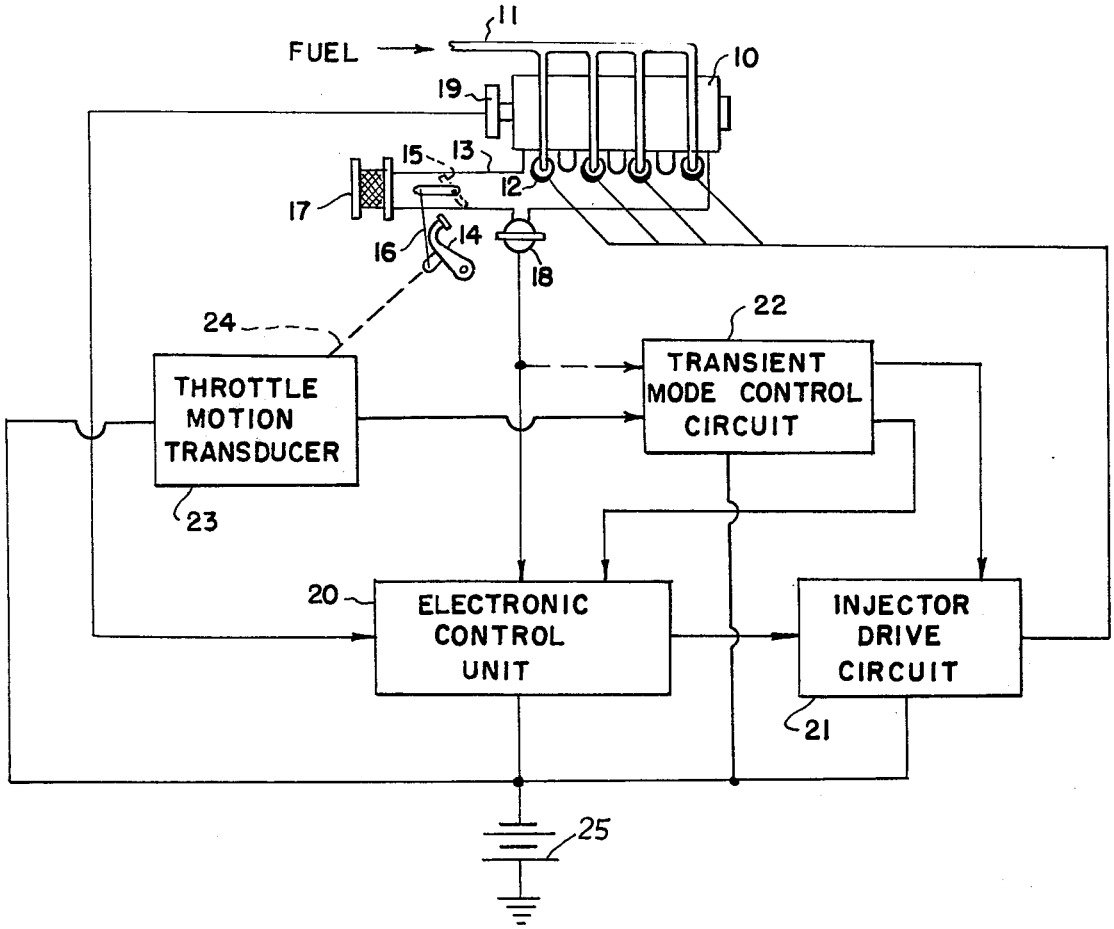
FIG. 1 PRIOR ART
FIG. 1 is a block diagram of an electronic fuel control system for an internal combustion engine embodying prior art transient mode control circuits.

A block diagram depicting prior art electronic fuel injection systems having auxiliary transient mode control is illustrated in FIG. 1. An internal combustion engine 10 receives a fuel via a fuel rail 11 connected to a plurality of electrically actuated fuel injectors 12 mounted in the engine's intake manifold 13 adjacent to intake ports of the engine's cylinders. The air flow to the engine is operator controlled by a mechanical control, such as foot pedal 14, which actuates a throttle valve 15 in the opening of the air intake manifold by means of a mechanical linkage 16. An air filter 17 at the entrance of the intake manifold 13 removes dust and dirt from the air prior to entering the intake manifold. The engine 10 has a plurality of sensors including an intake manifold pressure sensor 18 and a speed sensor 19 monitoring the operating conditions of the engine. The engine may also have other sensors, not shown, generating signals indicative of various other engine operating parameters, such as engine temperature, air temperature and oxygen content of the exhaust gases. These sensors and their function, as used in connection with electronic fuel injection systems, are well known and need not be discussed for an understanding of this invention.

The fuel requirements of the engine are computed by an electronic control unit 20 responding to the signals generated by the embodied sensors. The engine's fuel requirements, in the form of injection pulse signals generated by the electronic control unit 20, are communicated to an injector drive circuit 21 which amplifies the injection signals and distributes these amplified signals to the respective individual fuel injectors 12. As is known in the art, the signals generated by the electronic control unit 20 and distributed by the injector drive circuit 21 may be signals which are sequentially applied one at a time, to each of the individual fuel injectors in a predetermined order sychronized with the rotation of the engine; or the generated signals may be group injection signals which are applied alternatively to at least two groups of fuel injectors at predetermined rotational positions of the engine. Whether the electronic control unit generates sequential or group injection signals is immaterial to the invention and need not be discussed.

To accommodate transient modes of operation, such as acceleration fuel enrichment or deceleration fuel curtailment, the prior art systems embody an auxiliary transient mode control circuit 22 receiving signals indicative that the engine is in a transient mode of operation. The signals, indicative of the engine's transient mode of operation, may be derived from a throttle motion transducer 23 or from the pressure sensor 18 (dashed line). The throttle motion transducer 23 may be mechanically linked to either the throttle or operator control, as shown by dashed line 24, and generates a signal when the throttle 15 or operator 14 are moved to indicate a demand to the engine to accelerate or decelerate. The transducer 23 may be a switch, a potentiometer, a variable inductance reactor, or an electrical pulse generator generating a signal indicative of a transient condition. The electronic fuel control system is powered from a source of electrical power 25 which may be a battery or an engine driven generator of the type conventionally employed with internal combustion engines. The source of electrical power 25 provides the required electrical potentials and currents for the operation of engine sensors and the individual circuit in the system.

The transient mode control circuit responds to the signals indicative of a transient operational condition and generates signals which either increase the fuel flow during acceleration, or decrease the fuel flow during deceleration. For acceleration the transient mode control circuit may instantaneously generate one or more fuel enrichment pulses independent of the electronic control unit 20 which are applied directly to the injector drive circuit which causes the fuel injector to instantaneously provide additional fuel to the engine. In other forms the signal generated by the transient mode control circuit may be applied to the electronic control unit to lengthen the width of the signals generated by the electronic control unit. To differentiate between the signals generated by the electronic control unit and the enrichment pulses generated by the transient mode control circuit, the signals generated by the electronic control unit will hereinafter be referred to as the injection pulses and the pulse signals generated by the transient mode control circuit will be referred to as enrichment pulses. As previously discussed, the transient mode control circuit may generate enrichment pulses, generate signals to increase the width of the injection pulses, or both. In response to a deceleration command, the transient mode control circuit may generate a signal which may inhibit the generation of the injection pulses in the electronic control unit or terminate the injection pulses in the injector drive circuit. It is recognized that the above discussion only covers the basic concepts disclosed by the prior art and that some combinations may differ from that discussed. It is suffice, however, to state that fuel enrichment and curtailment to the engine during a transient mode of operation is empirically treated independent of the actual needs of the engine.

The fuel requirements of the engine are generally computed as a direct function of the air flow to the engine, which is mathematically derived from the pressure in the intake manifold, the volumetric displacement of the engine, the engine speed, the gas constant and the gas temperature in accordance with Equation (1) given below:

$$W_a = \frac{D_{mr} N P_m}{Rt} \qquad (1)$$

where;

$W_a$ = air flow to the engine $D_{mr}$ = volumetric displacement ($in^3$/Rad)

$N$ = engine speed (Rad/sec)
$P_m$ = manifold pressure (psia)
$R$ = gas constant (in-lbs/lb/°R)
$T$ = temperature of the gas (°R)

This equation defines the air flow only under steady state conditions. Under dynamic or transient conditions when the pressure in the manifold is changing, the compressibility of the gas must be taken in consideration and Equation (2) having a compressibility term more accurately defines the actual air flow.

$$W_a = \frac{D_{mv}NP_m}{RT} + \frac{V}{kRT}SP_m \qquad (2)$$

where;
$V$ = manifold volume (in$^3$)
$k$ = ratio of specific heats
$S$ = Laplace operator (d/dt)

Equation (2) has two terms, the first of which defines the steady state mode of operation and is identical to Equation (1). The second term is a compressibility term required to satisfy the laws with regards to the conservation of mass. The format of Equation (2) is equivalent to Kirchoff's current law which can be found in many textbooks on hydraulics and fluid devices. One such source is the textbook *Principles of Servomechanisms*, by G. S. Brown and D. P. Campbell, John Wiley and Sons, Inc., 1948 on pp. 37 and 38.

For fuel injection system the quantity of fuel to be injected per each revolution of the engine is computed by dividing the actual air flow by the engine speed, therefore, the quantity of fuel can be computed by dividing Equation (2) by the engine speed N resulting in Equation (3).

$$\frac{W_a}{N} = \frac{D_{mv}P_m}{RT} = \frac{VSP_m}{kNRT} \qquad (3)$$

For steady state operation the term $SP_m$ is zero ($dP_m/dt = 0$) and the air flow to the engine and, therefore, the computed quantity of fuel per revolution of the engine is the same as taught by the prior art. However, in a transient condition, the term $SP_m$ is not zero and the actual air flow to the engine will be either more or less than that calculated using the steady state term of the equation.

Some typical values of the term $SP_m$ are 15 psi/sec to 30 psi/sec for step changes in throttle opening. For a typical eight cylinder automotive engine the following parameters have been measured.

$D_{mv}$ = 34.13 in$^3$/Rad
$V$ = 300 in$^3$
$P_m$ = 8 psia
$N$ = 200 Rad/sec (2,000 RPM)
$k$ = 1.4

Using these parameters, the value for the first term of Equation (3) is:

$$\frac{D_{mv}P_m}{RT} = \frac{(34.13)(8)}{(640)(530)} = 8.05 \times 10^{-4} \text{ lbs/Rad}$$

and the value of the second term of Equation (3) is:

$$\frac{VSP_m}{kNRT} = \frac{(300)(30)}{(1.4)(200)(640)(530)} = 0.947 \times 10^{-4} \text{ lbs/Rad}$$

it is seen that the second term of Equation (3) is approximately 11.77% of the steady state term and at lower speeds this term would be even larger. If the second term is neglected during transient conditions, the fuel requirements of the engine would be computed on the basis of the first term only and the engine would receive an improper fuel/air mixture.

Prior art systems normally terminate the fuel flow during deceleration. However, this practice is not efficient for engines embodying thermal reactors to reduce the emission of undesirable exhaust pollutants. Terminating the fuel flow eliminates combustion within the engine and results in a temporary chilling of the thermal reactor which results in a reduction in the reactors ability to remove the undesirable pollutants. An electronic control unit computing the engine's fuel requirements in accordance with the air flow of Equation (3), however, would not have this deficiency and the quantity of fuel injected into the engine would remain proportional to the air flow under both acceleration and deceleration modes of operation.

Figure 2:
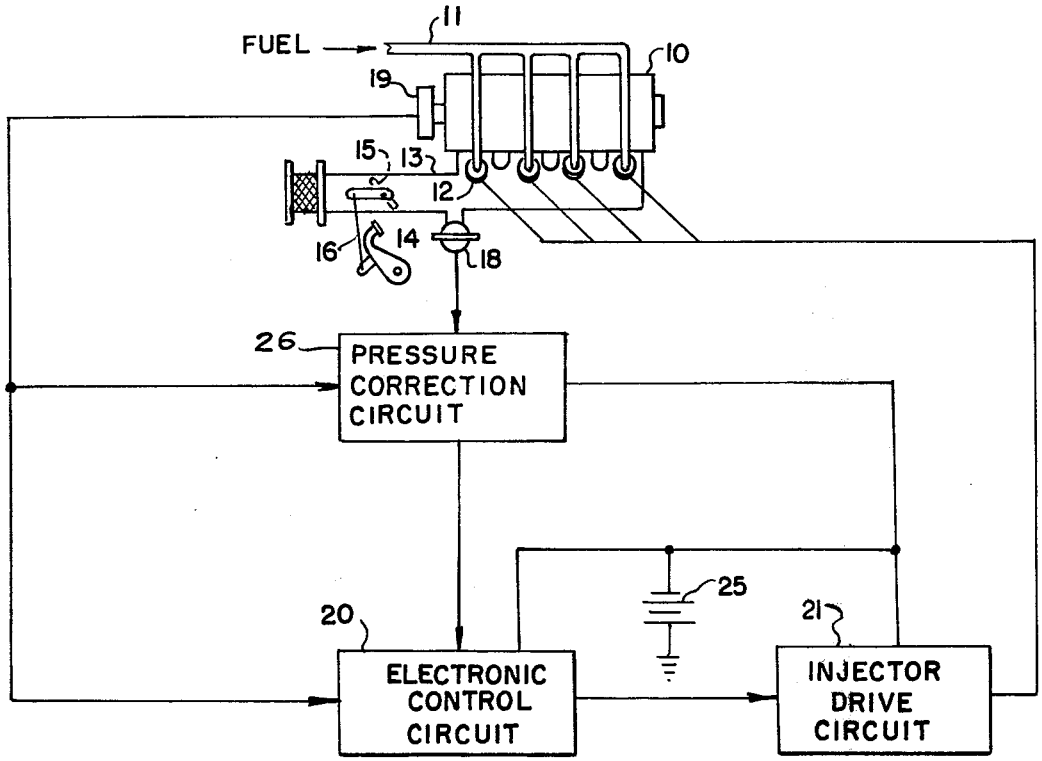
FIG. 2 is a block diagram of an electronic fuel control system for an internal combustion engine embodying the disclosed pressure correction circuit.

A fuel control system embodying the concepts of Equation (3) is illustrated in FIG. 2. FIG. 2 shows a typical fuel injection equipped internal combustion engine 10 having a fuel rail 11, fuel injectors 12, an air intake manifold 13, an operator controlled foot pedal 14, a throttle 15, a manifold pressure sensor 18, a speed sensor 19, an electronic control unit 20, an injector drive circuit 21 and source of electrical power 25. The function and interrelationship of these components are the same as described relative to FIG. 1. In place of the transient mode control circuit 22 and the throttle motion transducer 23 is a pressure correction circuit 100 receiving a signal from the pressure transducer and a signal from the speed sensor. The pressure correction circuit generates a signal indicative of the second term of Equation (3) which is added to the signal from the pressure sensor. Because the electronic control unit is adapted to receive a signal indicative of the pressure in the intake manifold, Equation (3) may be rewritten in the form:

$$P_c = P_m + \frac{V}{kND_{mv}}(dP_m/dt) \qquad (4)$$

where; $p_c$ is the corrected pressure signal. The output of the pressure correction circuit 200 is a sum signal having a value indicative of the sum of the two terms of Equation (4). The sum signal is then utilized in the electronic control unit the same as the signal from the pressure sensor alone to compute the fuel requirements of the engine.

The operation of the system is as follows: During steady state operation, the signal generated by the pressure correction circuit is zero, i.e. ($dP_m/dt = 0$), therefore, the sum pressure signal is identical to the signal generated by the pressure sensor and the electronic control unit computes the fuel requirements on the basis of the measured pressure.

When the pressure is increasing in the manifold, indicating a damand for acceleration, the pressure correction circuit 100 generates a signal proportional to 1/N ($dP_m/dt$) which when added to the signal from the pressure sensor, results in a sum signal indicative of a pressure higher than that generated by the pressure sensor alone. The electronic control unit responds to the sum signal and the generated injection signals are then lengthened to maintain the fuel delivery proportional to the actual air flow as determined from Equation (3).

When the pressure in the manifold is decreasing indicative of a demand for deceleration, the pressure correction circuit 100 generates a signal proportional to 1/N ($dP_m/dt$) which when added to the signal from the pressure sensor, produces a sum signal indicative of a pressure lower than the signal generated by the pressure sensor alone. The electronic control unit responds to this lower sum signal and the computed injection pulses are shortened to maintain the fuel delivery proportional to the actual air flow to the engine.

Figure 3:
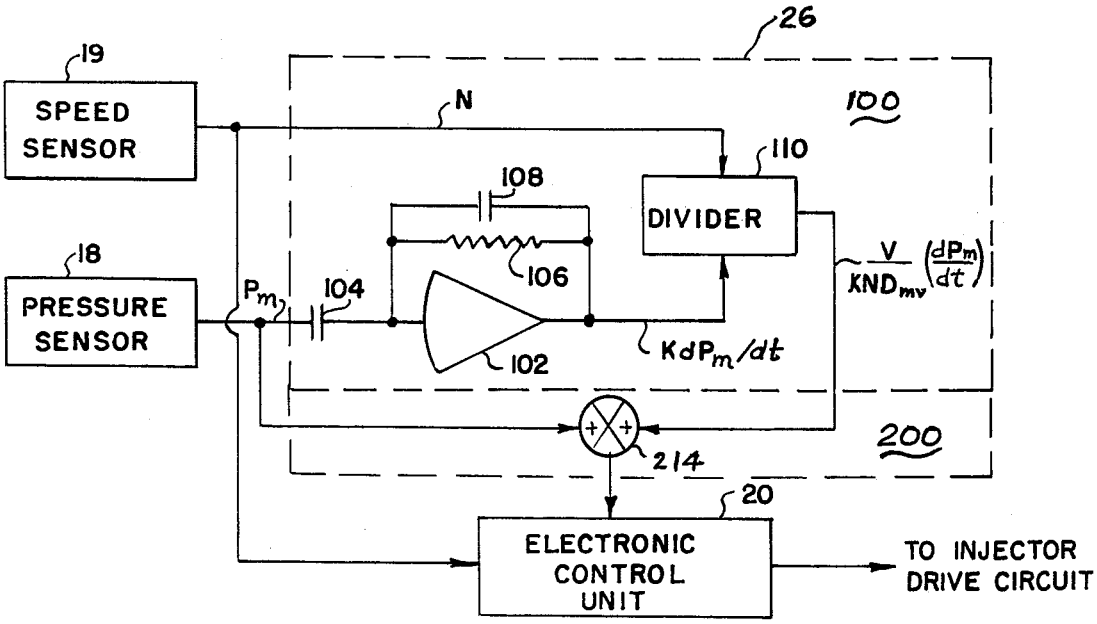
FIG. 3 is an electrical schematic of the pressure correction circuit.

The details of the pressure correction circuit 100 are illustrated in FIG. 3. The engine and the injector drive circuit are omitted to simplify the illustration. The pressure correction circuit 26 outlined by the dashed lines comprises a correction signal generating circuit 100 and a summing circuit 200. The correction signal generating circuit 100 receives signals from the pressure sensor 18 and the speed sensor 19, as indicated. The pressure sensor is connected to an operational amplifier 102 through a capacitance 104. A feedback resistance 106 is connected across the operational amplifier from the output to the input. The combination of operational amplifier 102, capacitance 104 and resistance 106 form an operational differentiator performing the mathematical function $dP_m/dt$. Resistance 106 may also be shunted by a capacitance 108 to form a low pass noise filter around the differential amplifier to substantially reduce the effects of the higher frequency noise generated by the pressure sensor in response to the opening and closing of the engine valves. A low pass filter having approximately a 2 Hertz corner frequency (time constant 0.0796 seconds) will reduce the value of the differentiated noise signal to an insignificant value when the engine is operating at relatively low speeds such as when idling. A four cylinder engine idling at 600 RPM will generate a noise signal at approximately 20 Hertz which is well above the corner frequency of the low pass filter.

The output of the operational differentiator and the output from the speed sensor 19 are connected to a divider circuit 110 which performs the mathematical function of dividing the output to the operational differentiator by the speed signal to generate a signal indicative of the second term of Equation (4). The output of the correction signal generating circuit 100 and the output pressure sensor 18 are then added in the summing circuit 200 shown as adder 214 to generate a sum signal having a value equal to the value of the pressure signal plus the correction signal generated by circuit 100.

Ideally, the correction signal generated by circuit 100 should have a value equal to a value indicative of the second term of Equation (4). However, in practical systems, the gain of the operational amplifier may be increased or decreased to compensate for other factors, such as wall wetting, maximum power during acceleration and other factors known to those skilled in the art.

In steady state operation, the signal generated by the pressure sensor has a constant value, therefore, no signal is communicated to the operational amplifier through capacitance 104 and the output signal is zero. The divider circuit 110 receiving the zero signal from the operational differentiator generates a zero signal which when added to the pressure signal $P_m$ in the summing circuit 200, has no effect, as previously discussed. When the signal generated by the pressure sensor 18 is changing indicative of a demand for acceleration or deceleration, the changing pressure signal is communicated to the operational amplifier 102 through capacitance 104. The operational differentiator differentiates this signal and generates a signal having a value proportional to $dP_m/dt$. The gain of the operational amplifier may be adjusted so that the value of the operational differentiator has a value approximately equal to $V/kD_{mv}$) $dP_m/dt$, having a polarity in the direction in which the pressure signal is changing. Alternatively, a second operational amplifier, not shown, may be used to multiply the differentiated pressure signal ($dP_m/dt$) by the constant $(V)/kD_{mv}$ to produce the desired signal $(V/kD_{mv})$ $dP_m/dt$. The output signal of the differentiator amplifier is then divided by the speed signal N to generate a signal having the value $(V/kD_{mv}N)$ $dP_m/dt$, which is added to the pressure signal $P_m$ in the summing circuit 200. When signal $P_m$ is increasing indicative of a demand for acceleration, the output of the summing circuit 200 is a signal indicative of a pressure grater than that generated by the pressure sensor alone, and when the signal $P_m$ is decreasing indicative of a demand from deceleration, the output of the summing circuit 200 is a signal indicative of a pressure lower than that generated by the pressure sensor alone.

Figure 4:
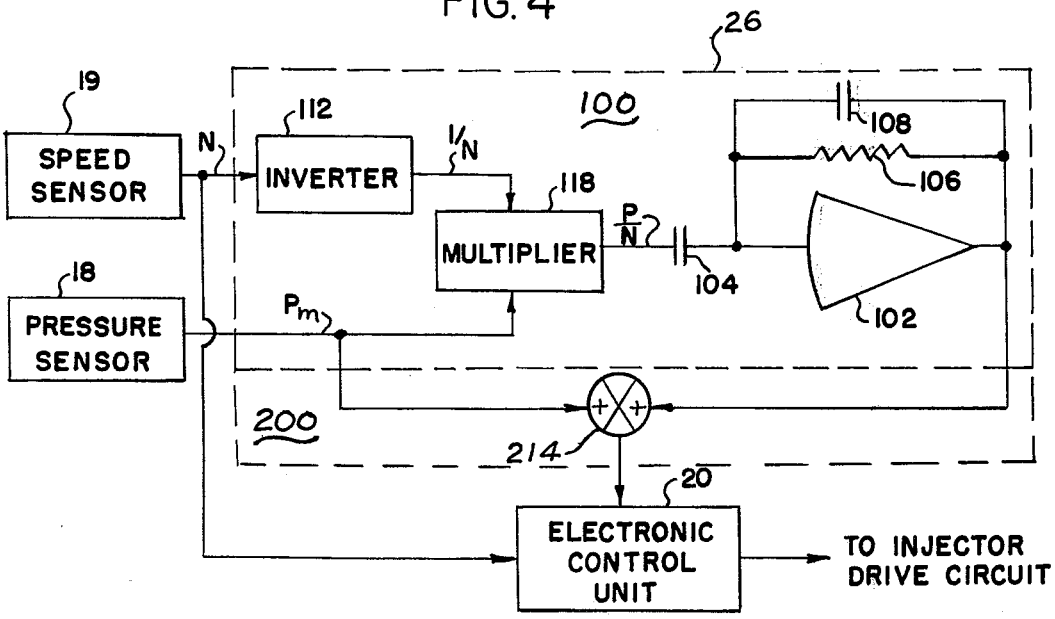
FIG. 4 is an alternate electrical schematic of the pressure correction circuit.

An alternate embodiment of the correction signal generating circuit 100 is shown in FIG. 4. In this embodiment the output of the speed sensor N is connected to an inverter circuit 112 which performs the mathematical function 1/N. The output of the inverter circuit 112 and the output of the pressure sensor 18 are connected to a multiplier circuit 114 which generates a produce signal having a value $P_m/N$. The output of the multiplier circuit 114 is connected to an operational differentiator comprising operational amplifier 102, capacitance 104, resistance 106 and capacitance 108. The elements of the operational differentiator and their functions are the same, as discussed relative to FIG. 3. In the embodiment of FIG. 4, the rate of change in the speed of the engine is small compared to the rate of change in the pressure in the intake manifold and, therefore, may be considered as a constant. The operation of the embodiment illustrated in FIG. 4 is comparable to that illustrated in FIG. 3 and a detailed discussion is believed unnecessary.

Various types of electronic control units for the generation of signals indicative of engine fuel requirements are taught by the prior art. One type of electronic control unit, "Fuel Injection Control System", U.S. Pat. No. 3,734,068 issued to J. N. Reddy May 22, 1973, expressly incorporated by reference herein, teaches a circuit which utilizes the pressure signal as a termination potential for generated ramp voltages determining length or duration of the injection pulse signals. Referring to FIG. 7 of the Reddy U.S. Pat. No. 3,734,068 the sum signal from the pressure correction circuit 26 is applied directly to the indicated pressure signal terminal connected to the base of transistor 172 in the comparator circuit 80. The sum signal establishes the termination potential of the generated ramp voltages, as illustrated in FIGS. 3 and 4 of the Reddy patent. The operation of the electronic control unit of U.S. Pat. No. 3,734,068 in response to the sum pressure signal from the pressure correction circuit remains the same as taught by Reddy therein.

Another comparable electronic control unit is taught in U.S. Pat. No. 3,815,561, "Closed Loop Engine Control System" issued to W. R. Seitz June 11, 1974 which also is expressly incorporated herein by reference. Referring to FIG. 3 of the Seitz patent, the sum signal from the pressure correction circuit 26 is applied directly to input terminal 53 in the comparator circuit 107. Thereafter the operation of the closed loop engine control system in response to the sum pressure signal is identical to that taught by Seitz therein.

An alternate type of electronic control unit prevalently used in the art embodies a monostable multivibrator receiving an electromagnetically induced signal indicative of the pressure in the engine's intake manifold for controlling the time a monostable multivibrator remains in its unstable state. A monostable multivibrator representative of the type embodied in these electronic control units, along with the pressure sensor and pressure correction circuit taught herein, are shown on FIG. 5. A trigger input terminal 300 is connected to junction point 302 by a capacitance 304 and a diode 306. Junction point 302 is also connected to a supply voltage designated as B+ through a resistance 308 and to the base of transistor 310 by a diode 312. The emitter of diode 310 is connected to ground and the collector to the voltage supply B+ by a resistance 314. The collector of diode 312 is also connected to the base of transistor 316 through resistance 318. The pressure sensor outlined by a dashed box 18 has a primary winding 320 and a secondary winding 322. The inductance of the primary winding 320 and the secondary winding is controlled by a moveable magnetically susceptable core 324 mechanically linked to move with a pressure sensitive element such as diaphragm 326. Diaphragm 326 has one surface exposed to ambient air pressure and the other surface exposed to the pressure in the intake manifold of the engine and is operative to move in response to a pressure differential between the ambient and manifold pressures. The pressure sensor may also embody a second set of windings 328 and 330 whose inductance is also controlled by the movement of magnetically susceptable core 324.

One end of the primary winding 320 is connected to the collector of transistor 316 and the other end of the primary winding is connected to the electrical power supply B+ through resistance 332. One end of the secondary winding is connected to the junction 336 between resistances 338 and 340. One end of winding 328 is connected to B+ through resistance 342 and the other of winding 328 is connected to ground. One end of winding 330 is connected to ground potential and the opposite end is connected to the pressure correction circit 100, the output of the pressure correction circuit is connected to an operational amplifier 202 having its output connected to a transistor 208. The base of the transistor 208 is biased by resistances 204 and 206 connected between B+ and ground potential. The collector of transistor 208 is connected to the B+ power supply through a resistance 210 and the emitter of transistor 208 is connected to resistance 322 at the end opposite to the end connected to the B+ power supply. The operational amplifier 202, transistor 208 and resistances 204, 206, 210 and 212 comprise the summing circuit 200 in this embodiment.

In operation current from the B+ power source through resistance 308 and diode 312 forwards bias transistor 310 into full conductance processing an effective ground potential at the collector of transistor 310. The ground potential at the collector of transistor 310 is applied to the base of transistor 316 through resistance 318 and renders transistor 316 nonconductive. This state, with transistor 310 conductive and transistor 316 nonconductive, is the stable state of the multivibrator.

A trigger pulse appearing at the trigger terminal 300 in the form of a negative or ground potential signal lowers the potential at the junction 302 terminating the current flow to the base of transistor 310 and renders transistor 310 nonconductive. A high potential appears at the collector of transistor 310 which by means of resistance 318 forward biases transistor 316 to the conductive state causing a current flow through resistance 332 and the primary coil 320 of the pressure sensor. The current flow through the primary coil 320 induces a current flow in the secondary coil 322 which draws current from junction 302 through diode 334. The current flow through the secondary winding 322 maintains the junction 302 at a low potential and transistor 310 in the nonconductive state. Transistor 310 remains in the nonconductive state until the induced current in the secondary winding is no longer capable of keeping the potential of junction 302 below a predetermined value. When the potential of junction 302 rises above the predeterminable value, the multivibrator returns to its stable state with transistor 310 conductive and transistor 316 nonconductive. The duration of the induced current in the secondary winding and, therefore, the duration of the period the multivibrator remains in its unstable state, is a function of the RL time constant of limiting resistance 332 and the inductance or primary winding 320. In normal operation of an electronic control unit, changing the position of the magnetically susceptable core 324 changes the inductance L of the primary winding 320 and the RL time constant of the induced current in the secondary winding 322. By this means the length of time the multivibrator is in the unstable state is controlled in accordance with the pressure in the intake manifold.

The operation of the pressure correction circuit 100 and adder circuit 200 in combination with this type of monostable multivibrator is as follows. Changing the position of the magnetically susceptable core 324 due to a change in pressure in the intake changes the inductance of windings 328 and induces a current in winding 330 generating a signal indicative of a pressure change which is transmitted to the pressure correction circuit 100. Here the correction circuit 100 does not require a differentiating amplifier as the dynamic movement of core 324 performs the differentiation. The pressure correction circuit computes a signal having a value proportional to $(V/kD_{mv}N)\ dP_m/dt$ which is communicated to the summing circuit 200 which is illustrated as a variable current source connected in parallel with resistance 322. The signal generated by the pressure correction circuit is input to an operational amplifier 202 which generates a signal applied to the base of transistor 208 controlling the current flow through a path parallel to resistance 332. This circuit arrangement comprising resistance 210, 212, and 332 and transistor 208 acts as a variable resistance in series with winding 320. Increasing the current flow through transistor 208 effectively decreases the effective resistance of the circuit, increases the time constant of the inductive circuit connected to the collector of transistor 316 and increases the time the current induced in the secondary winding 322 maintains transistor 310 in its nonconductive state. Decreasing the current flow through transistor 208 increases the effective resistance of the inductive circuit and decreases the time the multivibrator is held in its unstable state.

Persons skilled in the art will recognize that the signal from the pressure correction circuit may alternatively add or subtract from the signal induced in the secondary winding 322 at other points in the multivibrator circuit. For instance, the signal from the summing circuit may alter the potential at circuit junctions 302 or 336 to effectively produce the same results.

Figure 5:
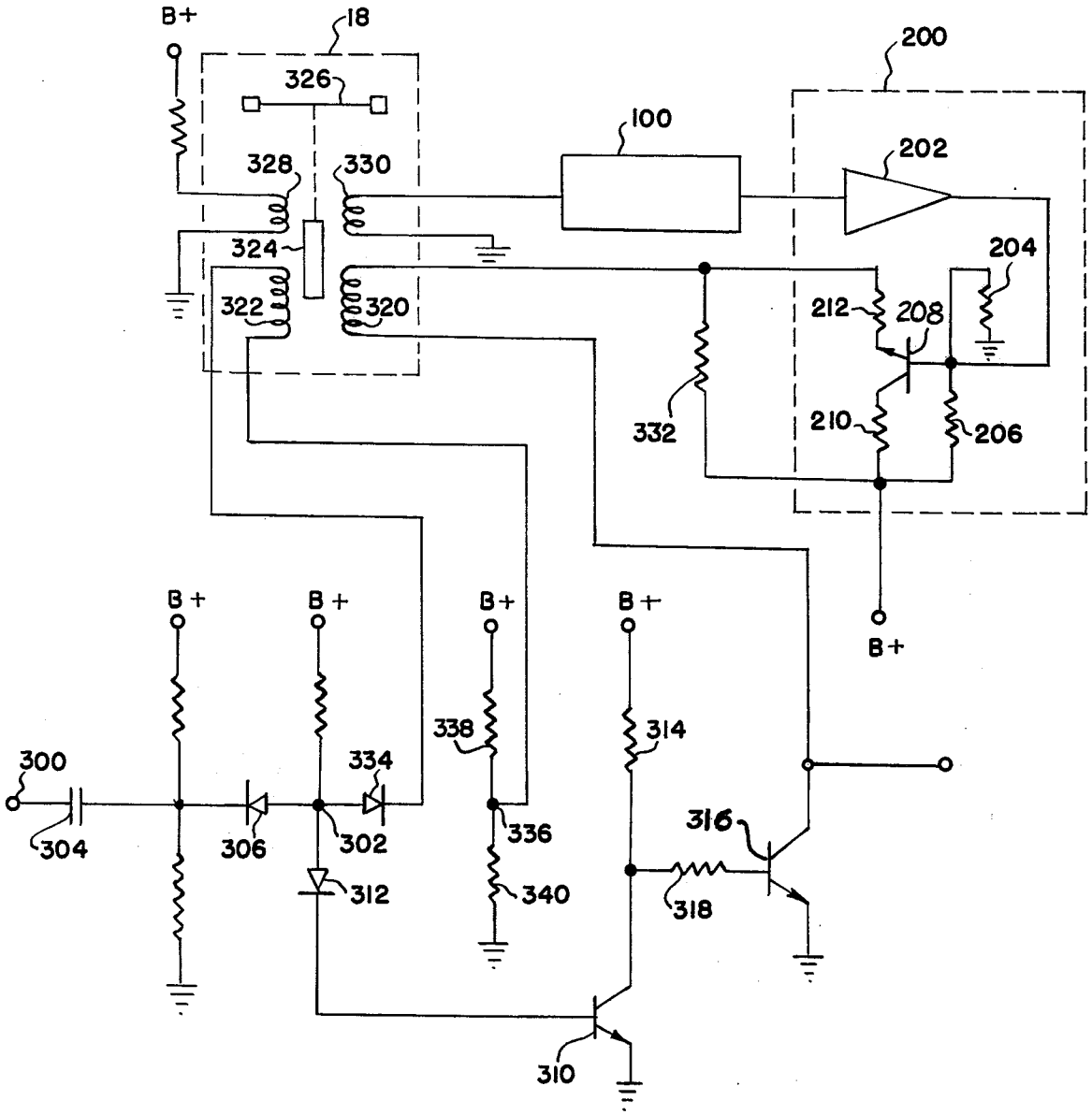
FIG. 5 is a circuit diagram showing the pressure correction circuit adapted to an electronic control unit embodying a monostable multivibrator.

Although the signal indicative of a pressure change in FIG. 5 is shown as being generated by a second set of windings on the pressure sensor, alternate methods of generating a signal indicative of the change in pressure may equally be used. For instance, the moveable member 326 may also be used to move a wiper arm of a potentiometer. Alternatively, a second pressure sensor may be used to provide a signal to the pressure correction circuit.

It is not intended that the invention be limited to the embodiments illustrated and described herein. It is recognized that a person skilled in the art will be able to conceive alternate circuits embodying the principles disclosed herein. Further, the principles may be applied to other types of electronic control units for electronic fuel injection systems than the two types discussed herein.

What is claimed is:

1. An electronic fuel injection system for an internal combustion engine comprising:

engine sensor means for generating signals indicative of engine operating conditions, said sensor means including pressure sensor means for generating a pressure signal indicative of engine air intake manifold pressure, and speed sensor means for generating a speed signal indicative of engine operating speed;

pressure signal correction circuit means for generating a corrected pressure signal having a value equal to the sum of said pressure signal and a correction signal generated in response to said pressure signal and said speed signal, when the pressure signal is changing and indicative of a transient condition;

electronic control unit means for generating electrical signals indicative of engine fuel requirements in response to signals generated by said engine sensors, including said speed signal and said corrected pressure signal; and fuel delivery means for delivering fuel in response to the signals generated by said electronic control unit means.

2. The electronic fuel injection system of claim 1 wherein said pressure signal correction circuit means comprises:

means for generating said pressure correction signal having a value directly proportional to the first time derivative of the pressure signal and inversely proportional to the speed signal; and means for adding said pressure correction signal to the pressure signal to generate said corrected pressure signal.

3. The electronic fuel injection system of claim 2 wherein said electronic control unit generates said electrical signals as a function of engine air, wherein air flow is given by the equation;

$$\frac{W_a}{N} = \frac{D_{MV}P_M}{RT}$$

where;

$W_a$ = engine air flow $D_{mv}$ = engine volumetric displacement (in$^3$/Rad)

$N$ = engine speed (Rad/sec)

$P_m$ = manifold pressure (lbs/sq. inch absolute)

$R$ = gas constant (inch lb/lb °R)

$T$ = gas temperature (°R)

and wherein, under transient operating conditions the actual engine air flow as a function of engine speed and manifold air pressure is given by the equation;

$$\frac{W_a}{N} = \frac{D_{mv}P_m}{RT} = \frac{V}{kNRT}\,(dP_m/dt)$$

where;

$V$ = manifold volume (inches$^3$)

$k$ = ratio of specific heat $dP_m/dt$ = first time derivative of the manifold pressure said means for generating a pressure correction signal generates a signal having a value $V/KND_{mv}\ (dP_m dt)$ and;

said means for adding generates a signal having a value $P_m V/kND_{mv}\ (dP_m/dt)$.

4. In combination with an electronic fuel injection system for an internal combustion engine, said electronic fuel injection system having engine sensors generating signals indicative of engine operating conditions, including pressure sensor means generating pressure signals indicative of engine air intake manifold pressure and speed sensor means generating speed signals indicative of engine speed, and an electronic control unit generating electrical signals indicative of engine fuel requirements, and at least one injector means for delivering fuel in response to the electrical signals generated by the electronic control unit, a pressure signal correction circuit means electrically disposed between said pressure sensor and said electronic control unit for generating corrected pressure signals in response to said pressure signals and said speed signals, said corrected pressure signal being indicative of the actual engine air flow during steady state and transient operating conditions.

5. The combination of claim 4 wherein the electronic control unit generates said electrical signals as a function of engine air flow determinable from the equation:

$$\frac{W_a}{N} = \frac{D_{mv}P_m}{RT}$$

where;

$W_a$ = engine air flow to the engine $D_{mv}$ = engine volumetric displacement (inch$^3$/Rad)

$N$ = engine speed (Rad/sec)

$P_m$ = manifold air pressure (lbs/sq inch absolute)

$R$ = gas constant (inch lb/lb °R)

$T$ = gas temperature (°R)

and wherein the actual engine air flow as a function of engine speed and manifold air pressure is given by the equation:

$$\frac{W_a}{N} = \frac{D_{mv}P_m}{RT} = \frac{V}{kNRT}(dP_m/dt)$$

where:

$V$ = manifold volume (inches$^3$)

$K$ = ratio of specific heats $dP_m/dt$ = first derivative of the manifold pressure $P_m$ with respect to time said pressure signal correction circuit means generates corrected pressure signals indicative of the sum of said pressure signal and a pressure correction signal, said pressure correction signal having a value directly proportional to the first derivative of the time variations of said pressure signal and inversely proportional to said speed signal.

6. The combination of claim 5 wherein said pressure correction circuit comprises:

circuit means for generating said pressure correction signal in response to the generated pressure and speed signals; and summing means receiving the generated pressure signal and said correction signal to generate said corrected pressure signal.

7. The combination of claim 5 wherein said circuit means for generating said correction signal comprises:

circuit means receiving the generated pressure signal for generating a derivative signal indicative of the first time derivative of the pressure signal and;

circuit means dividing said derivative signal by said speed signal to generate said correction signal.

8. The combination of claim 7 wherein said circuit means for generating a correction signal generates a singal having a value $V/kND_{mv}(dP_m/dt)$.

9. The combination of claim 7 wherein the air pressure being detected by the pressure sensor has noise, said noise having a frequency proportional to the engine speed, said pressure signal correction circuit means further includes a low pass filter circuit to reduce the sensitivity of the circuit means for generating a derivative signal to the pressure signals generated by the pressure sensor in response to the noise of the air pressure being detected.

10. In an electronic fuel injection equipped internal combustion engine system having an internal combustion engine, engine sensors generating signals indicative of the engine's operating conditions, including pressure sensor means generating pressure signals indicative of the pressure in the engine's air intake manifold and speed sensor means generating speed signals indicative of the rotational speed of the engine, an electronic control unit responsive to at least said pressure and said speed signals for generating electrical signals indicative of the engine's fuel requirements, and at least one injector means for injecting fuel into the engine in response to the electrical signals generated by the electronic control unit, an improvement for correcting the pressure signals generated by the pressure sensor means during transient modes of operation comprising:

means responsive to the signals generated by the pressure sensor means and the speed sensor means for generating pressure correction signals to compensate for the compressibility of air intake manifold when the engine is in a transient mode of operation; and means for summing said pressure correction signals to said pressure signals to generate a corrected pressure signal;

wherein said electronic control unit generates said electrical signals in response to said corrected pressure signal.

11. The improvement of claim 10 wherein the electronic control unit generates said electrical signals as a function of the air flow to the engine per engine revolution in accordance with the equation:

$$\frac{W_a}{N} = \frac{D_{mv}P_m}{RT}$$

where:

$W_a$ = the air flow into the engine $D_{mv}$ = volumetric displacement of the engine (inch$^3$/Rad)

$N$ = engine speed (Rad/sec)

$P_m$ = manifold air pressure (lbs/sq inch absolute)

$R$ = gas constant (inch lb/lb °R)

$T$ = gas temperature (°R)

and wherein the actual air flow to the engine per revolution is given by the equation:

$$\frac{W_a}{N} = \frac{D_{mv}P_m}{RT} = \frac{VSP_m}{kNRT}$$

where:

$V$ = manifold volume (inches$^3$)

$k$ = ratio of specific heats $S$ = Laplace Operator ($d/dt$)

said means for generating said correction signal generates a signal proportional to $SP_m/N$.

12. The improvement of claim 11 wherein said means for generating said correction signal generates a singal having a value $VSP_m/kND_{mv}$.

13. The improvement of claim 11 wherein said means for generating said correction signal includes:

means receiving said pressure signal for generating a derivative signal indicative of the first time derivative of said pressure signal; and means for dividing said derivative signal by said speed signal to generate said correction signal.

14. The improvement of claim 13 wherein said means for generating said derivative signal includes:

a capacitor receiving said pressure signal;

an operational amplifier having an input connected to said capacitor and an output; and a feedback resistance having one end connected to the input of said operation amplifier and the other end connected output of said operational amplifier.

15. The improvement of claim 14 wherein said engine has at least one cylinder, and at least one air intake valve associated with said at least one cylinder, said air intake valve periodically opening to admit air from the manifold into said at least one cylinder and wherein the pressure in the manifold fluctuates with the opening and closing of said at least one valve generating noise superimposed on the generated pressure signal, said means for generating a derivative signal further includes a low pass filter to remove the noise superimposed on the pressure signal generated by the opening and closing of the engine's air intake valves.

16. The improvement of claim 15 wherein said low pass filter comprises a capacitance in parallel with said feedback resistance.

17. The improvement of claim 11 wherein said means for generating said correction signal includes:

means for generating a derivative signal indicative of the first derivative of said pressure signal;

means for generating an inverted signal having a value inversely proportional to said speed signal; and means for multiplying said derivative signal by said inverted signal to generate said correction signal.

18. The improvement of claim 17 wherein said engine has at least one cylinder, and at least one air intake valve associated with said at least one cylinder, said air intake valve periodically opening to admit air from the manifold into said at least one cylinder, and wherein the pressure in the manifold fluctuates with the opening and closing of said at least one valve generating noise superimposed on the generated pressure signal, said means for generating a derivative signal further includes a low pass filter to remove the noise superimposed on the pressure signal generated by the opening and closing of the engine's valves.

19. The improvement of claim 11 wherein said pressure sensor means is a variable inductance transformer having primary and secondary electrical windings and means for changing the value of the inductance in said windings as a function of the manifold pressure, and wherein said electronic control unit generates a first signal communicated to the pressure sensor's primary winding and generates said electrical signals indicative of the engine's fuel requirements in response to the signals induced in the secondary winding wherein said induced signals are indicative of the pressure in the intake manifold, said means for summing is means for combining said correction signal to said induced signal to generate said corrected pressure signal.

20. The improvement of claim 19 wherein said means for combining said correction signal to said induced signal is a means for adding said correction signal to said first signal.

21. A circuit for use in combination with a pressure sensor and an internal combustion engine having an air intake manifold and electronic fuel control to correct the signals generated by the pressure sensor during transient operating conditions, wherein said pressure sensor generates pressure signals indicative of the pressure in the engine's air intake manifold and said engine has at least one other sensor generating a speed signal indicative of the rotational speed of the engine comprising:

differentiator circuit means receiving said pressure signals and said speed signals for generating pressure correction signals having a value proportional to the first time derivative of the pressure in the intake manifold and inversely proportional to the rotational speed of the engine; and means for summing said pressure correction signal to said pressure signal to generate a corrected pressure signal.

22. In combination with a utilization device having a fluid intake manifold and a pressure sensor generating a signal indicative of the fluid pressure in the intake manifold, a circuit for correcting the pressure signal generated by a pressure sensor for the compressibility of the fluid flowing in the intake manifold of the utilization device comprising:

sensor means generating speed signals indicative of the speed of fluid flow through the utilization device;

circuit means receiving said pressure signals and said speed signals for generating a pressure correction signal having a value proportional to the first time derivative of the pressure signal and inversely proportional to the speed signal; and means for adding said pressure correction signal to said pressure signal.

23. A method for correcting the pressure signals generated by a pressure sensor monitoring the pressure in the intake manifold of an internal combustion engine for the compressibility of the air during transient modes of operation comprising the steps of:

detecting the pressure in the engine's intake manifold with a pressure sensor to generate pressure signals;

differentiating the pressure signals generated by the pressure sensor to generate a differentiated signal having a value proportional to the first time derivative of pressure in the intake manifold;

detecting the rotational speed of the engine to generate a speed signal;

dividing the differentiated signal by said speed signal to generate a correcton signal having a value proportional to the first time derivative of the pressure and inversely proportional to the rotational speed of the engine; and adding said correction signal to pressure signal to generate a pressure signal compensated for the compressibility of the air.

* * * * *